US012642423B2

(12) United States Patent
Kasner et al.

(10) Patent No.: US 12,642,423 B2
(45) Date of Patent: Jun. 2, 2026

(54) DISHWASHER AND RACK ASSEMBLY

(71) Applicant: WHIRLPOOL CORPORATION, Benton Harbor, MI (US)

(72) Inventors: Rebecca Katherine Kasner, Saint Joseph, MI (US); Elliott V. Stowe, Stevensville, MI (US); Gregg Patrick Fitzgerald, Eau Claire, MI (US); Yu Liu, Saint Joseph, MI (US); Richard Lee Hammond, Mattawan, MI (US); Christopher D. Cullen, Saint Joseph, MI (US); Stacey Hollis Assell, Saint Joseph, MI (US); Avery Josephine Saylor, Saint Joseph, MI (US); Ameresh Viswanathan, Saint Joseph, MI (US); Chandler Alexander Longley, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 55 days.

(21) Appl. No.: 18/390,080

(22) Filed: Dec. 20, 2023

(65) Prior Publication Data

US 2024/0215798 A1 Jul. 4, 2024

Related U.S. Application Data

(60) Provisional application No. 63/435,945, filed on Dec. 29, 2022.

(51) Int. Cl.

| | |
|---|---|
| ***A47L 15/14*** | (2006.01) |
| ***A47L 15/42*** | (2006.01) |
| ***A47L 15/50*** | (2006.01) |

(52) U.S. Cl.

CPC ..... *A47L 15/505* (2013.01); *A47L 15/14* (2013.01); *A47L 15/4257* (2013.01); *A47L 15/4278* (2013.01); *A47L 15/50* (2013.01); *A47L 15/507* (2013.01)

(58) Field of Classification Search

None

See application file for complete search history.

(56) References Cited

U.S. PATENT DOCUMENTS

| | | | | |
|---|---|---|---|---|
| 7,909,046 | B2 | 3/2011 | Kim et al. | |
| 9,510,729 | B2 | 12/2016 | Fey et al. | |
| 9,955,849 | B2 | 5/2018 | Godehardt et al. | |
| 2009/0007941 | A1* | 1/2009 | Kim | A47L 15/4257 134/107 |

FOREIGN PATENT DOCUMENTS

| | | | |
|---|---|---|---|
| CN | 114828723 | A | 7/2022 |
| DE | 19960496 | A1 | 7/2001 |
| DE | 102011085417 | B4 | 5/2016 |
| EP | 2941172 | B1 | 3/2017 |

* cited by examiner

*Primary Examiner* — Levon J Shahinian

(74) *Attorney, Agent, or Firm* — McGarry Bair PC

(57) ABSTRACT

A dishwasher has a chassis, at least one spray nozzle, a dish rack, a closure and at least one loading zone marker. The chassis has a base and forms a tub. The tub at least partially defines a treating chamber. The at least one spray nozzle is configured to exhaust a flow of treating fluid into the treating chamber. The dish rack is provided within the treating chamber. The closure is moveably coupled to the base.

20 Claims, 12 Drawing Sheets

DISHWASHER AND RACK ASSEMBLY

CROSS-REFERENCE TO RELATED APPLICATIONS

This application claims priority to and the benefit of U.S. Provisional Patent Application No. 63/435,945 filed Dec. 29, 2022, which is incorporated herein by reference.

BACKGROUND

Contemporary automatic dish treating appliances for use in a typical household include a cabinet with an access opening and a tub that can have an open front and at least partially defines a treating chamber into which items, such as kitchenware, glassware, and the like, can be placed to undergo a treating operation, such as washing. A spraying system with multiple sprayers can be provided for recirculating liquid throughout the tub to remove soils from the dishes. The dishwasher can be further provided with a door assembly, which can be hingedly mounted to the tub or to the cabinet for pivoting movement about a pivot axis between closed and opened positions to selectively close and open the open front and the access opening.

At least one rack or basket for supporting soiled dishes can be provided within the tub. The at least one rack or basket can be provided in the form of upper and lower dish racks. A silverware or utensil basket for holding utensils, silverware, cutlery, and the like, may also be provided and is generally removably mounted to the door assembly or within one of the dish racks. The dish racks can further include a plurality of tines or sets of tines that can be provided in a variety of configurations within the dish racks for supporting soiled dishes. At least one of the dish racks can also define a portion of the dish rack or a subset of the tines within the dish rack that form a specific target loading zone for dish items, such as for loading of certain types of dish items or for loading of dish items to be targeted during a specific cycle of operation.

BRIEF DESCRIPTION

An aspect of the present disclosure relates to a dish rack assembly comprising a dish rack having a bottom wall, opposing side walls, and opposing front and rear walls at least partially defining an interior, and at least one loading zone marker provided with the dish rack to indicate a portion of the dish rack defining a loading zone for dish items for treatment in a specific treating cycle of operation or for a specific type of dish items.

Another aspect of the present disclosure relates to a loading zone marker for use with a dish rack of a dish treating appliance, the dish rack having a bottom wall, opposing side walls, and opposing front and rear walls at least partially defining an interior, and at least one loading zone marker provided with the dish rack to indicate a portion of the dish rack defining a loading zone for dish items for treatment in a specific treating cycle of operation or for a specific type of dish items.

DETAILED DESCRIPTION

In order to provide more flexibility to users for customized or specific treating cycles of operation, at least one loading zone marker can be included with at least one of the dish racks to indicate a portion of the dish rack defining a specific loading zone for dish items for treatment in a specific treating cycle of operation or for a specific type of dish items loaded into the dish treating appliance. In some cases, a user may desire to clean a smaller load of dish items, and/or a load of dish items of a specific type or types, rather than running a full cycle of operation for all of the dish racks in the dish treating appliance. By way of non-limiting example, such a cycle of operation can include a quick wash treating cycle or a wash cycle for treating specifically pet items, such as bowls or toys. To help improve cleaning efficacy and the efficiency of such a cycle, loading zone markers can be provided with the at least one of the dish racks to indicate to the user where such dish items should be loaded for the best cleaning performance in such a shortened cycle, such as by directing a user to place the dish items within the portion of the dish rack that receives a spray of treating liquid before other positions within the dish rack, for maximum cleaning performance within a shortened cycle time.

Aspects of the present disclosure relate to a loading zone marker for use with a dish rack of a dish treating appliance. The dish rack includes a bottom wall, opposing side walls, and opposing front and rear walls at least partially defining an interior. The loading zone marker can be suitable for any manner of applications including that of the household dish treating appliance of FIG. 1, which is illustrated by way of example and not limitation.

Figure 1:
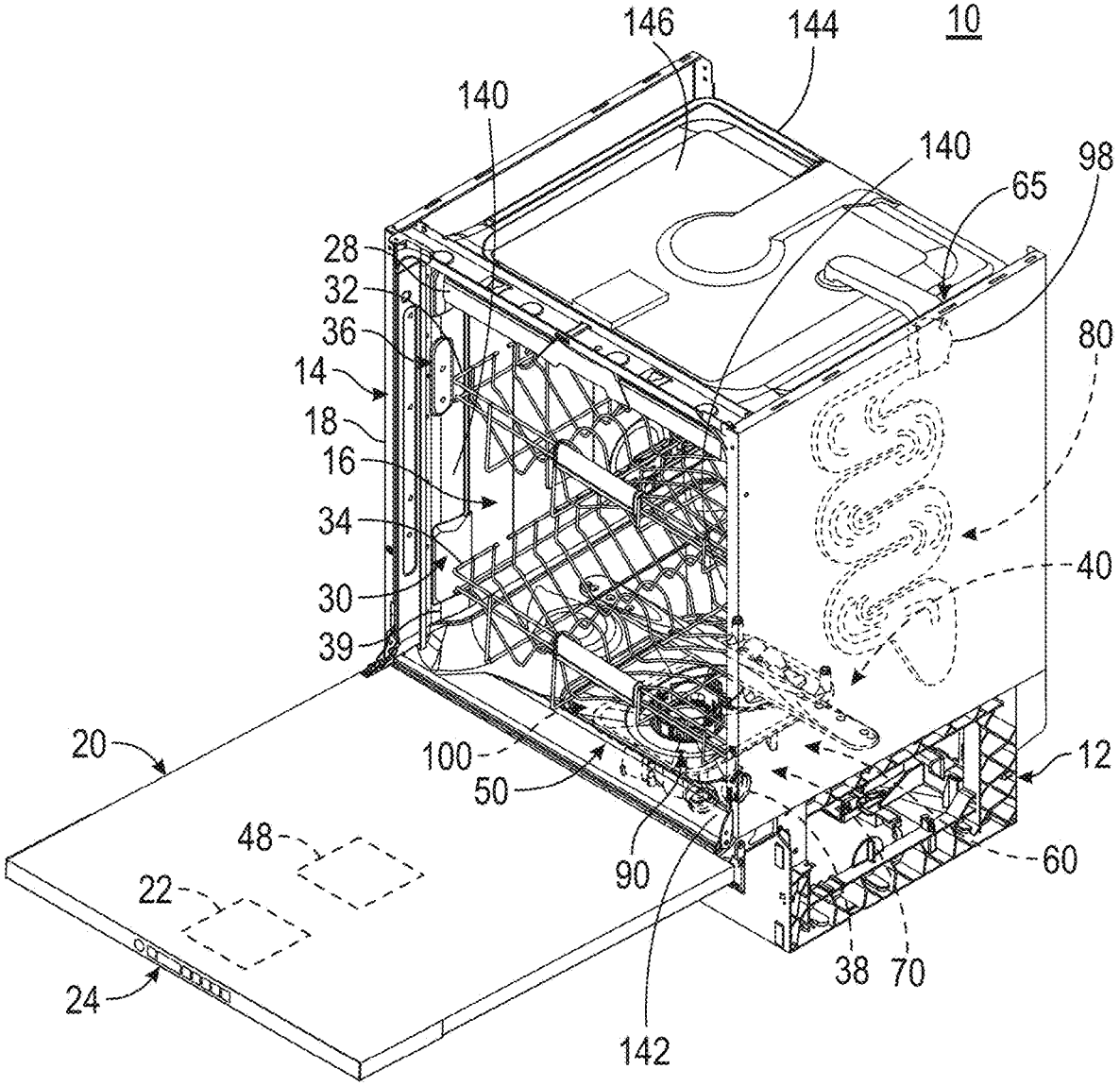
FIG. 1 is a top, front, and right-side perspective view of an automatic dish treating appliance having multiple systems for implementing an automatic cycle of operation.

FIG. 1 illustrates an automatic dish treating appliance 10, illustrated herein as a dishwasher 10, capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, silverware, and other utensils. As illustrated, the dishwasher 10 is a built-in dishwasher 10 implementation, which is designed for mounting under a countertop or other work surface. However, this description is applicable to other dishwasher implementations such as a stand-alone, multi-tub-type, drawer-type, or a sink-type, for example, as well as dishwashers having varying widths, sizes, and capacities. The dishwasher 10 shares many features of a conventional automatic dishwasher, which may not be described in detail herein except as necessary for a complete understanding of aspects of the disclosure.

The dishwasher 10 has a variety of systems, some of which are controllable, to implement the automatic cycle of operation. A chassis or cabinet is provided to support the variety of systems needed to implement the automatic cycle of operation and can define an interior. As illustrated, for a built-in implementation, the chassis or cabinet includes a frame in the form of a base 12 on which is supported an open-faced tub 14, which at least partially defines a treating chamber 16, having an access opening, illustrated herein as an open face 18, for receiving the dishes. The open-faced tub 14 can have at least a pair of opposing side walls 140 that are spaced apart from one another, such as by being spaced apart by a bottom wall 142, a rear wall 144, and/or a top wall 146. The pair of opposing side walls 140, the bottom wall 142, the rear wall 144, and the top wall 146 can further be thought of as at least partially defining the treating chamber 16, and optionally also the open face 18 to serve as the access opening.

A closure in the form of a door assembly 20 can be hingedly or pivotally mounted to the base 12, or to any other suitable portion of the cabinet or chassis or of the tub 14, for movement relative to the tub 14 between opened and closed positions to selectively open and close the open face 18 of the tub 14. In one example, the door assembly 20 is mounted for pivoting movement about a pivot axis relative to the base 12, the tub 14, or the open face 18. In the opened position, a user can access the treating chamber 16, as shown in FIG. 1, while, in the closed position (not shown), the door assembly 20 covers or closes the open face 18 of the treating chamber 16. Thus, the door assembly 20 provides selective accessibility to the treating chamber 16 for the loading and unloading of dishes or other items.

The chassis or cabinet, as in the case of the built-in dishwasher implementation, can be formed by other parts of the dishwasher 10, like the tub 14 and the door assembly 20, in addition to a dedicated frame structure, like the base 12, with them all collectively forming a uni-body frame by which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, air supply system 65, heating system 90, and filter system 100. These systems are used to implement one or more treating cycles of operation for the dishes, for which there are many, one of which includes a traditional automatic wash cycle.

A basic traditional automatic cycle of operation for the dishwasher 10 has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The amounts of water, treating chemistry, and/or rinse aid used during each of the multiple wash or rinse steps can be varied. The wash phases and rinse phases can include the heating of the water, even to the point of one or more of the phases being hot enough for long enough to sanitize the dishes. A drying phase can follow the rinse phase(s). The drying phase can include a drip dry, a non-heated drying step (so-called "air only"), heated dry, condensing dry, air dry or any combination. These multiple phases or steps can also be performed by the dishwasher 10 in any desired combination.

A controller 22 can also be included in the dishwasher 10 and operably couples with and controls the various components of the dishwasher 10 to implement the cycles of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can provide an input and output function for the controller 22. While the user interface 24 is illustrated in FIG. 1 as being provided on a top surface of the door assembly 20, it will be understood that the user interface 24 can be provided at any suitable location on the door assembly 20, such as on a front surface of the door assembly 20.

The user interface 24 can include operational controls such as one or more knobs, dials, lights, switches, displays, touch screens and the like for communicating with the user, such as enabling a user to input commands, such as a cycle of operation, to the controller 22 and to receive information, for example about the selected cycle of operation. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the dishwasher 10 and can allow the controller 22 to communicate with the user in a variety of ways. For example, the controller 22 can be configured to send a text message to the user, send an electronic mail to the user, or provide audio information to the user either through the dishwasher 10 or utilizing another device such as a mobile phone.

The controller 22 can include the machine controller and any additional controllers provided for controlling any of the components of the dishwasher 10. For example, the controller 22 can include the machine controller and a motor controller. Many known types of controllers can be used for the controller 22. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

The dish holding system 30 can include any suitable structure or structures for receiving or holding dishes within the treating chamber 16. Exemplary dish racks are illustrated in the form of an upper dish rack 32 and lower dish rack 34, commonly referred to as "racks", which are located within the treating chamber 16. The upper dish rack 32 and the lower dish rack 34 each define an interior and are typically mounted for slidable movement in and out of the treating chamber 16 through the open face 18 for ease of loading and unloading. In one example, it is common for the upper dish rack 32 to be slidably mounted within and to the tub 14 by the use of a suitable drawer withdrawal assembly, such as by the use of drawer guides, slides, or rails 36, while the lower dish rack 34 is instead typically provided with wheels or rollers 38 that can roll along a travel path 39 defined by at least a portion of the dishwasher 10. For example, it is typical for the lower dish rack 34 to be slidable along the travel path 39 such that the lower dish rack 34 can roll along the travel path 39 and then continue to roll onto the door assembly 20, when the door assembly 20 is in the opened position and allows for withdrawal of the dish racks 32, 34.

By way of further example, in such a case, it is also typical that the travel path 39 can include a type of rails 39, but that rails 39 for the lower dish rack 34 may differ in structure from the rails 36 for the upper dish rack 32, and in particular such that the rails 39 may be provided simply as a ledge or a surface formed by the tub 14, such as formed or carried by the side walls 140 or the bottom wall 142 of the tub 14. By providing the rails 39 for the lower dish rack 34 as a simpler support surface, such as a ledge, rather than a more restrictive or enclosing structure such as the rails 36, the rails 39 are better able to accommodate movement or instability of the lower dish rack 34 as the lower dish rack 34 rolls onto the door assembly 20, going from the static, stable tub 14 to the movable door assembly 20. In this way, the rails 39 allow more tolerance for movement as the lower dish rack 34 rolls along the door assembly 20.

In addition, dedicated dish racks can also be provided. One such dedicated dish rack is a third level rack 28 located above the upper dish rack 32. Like the upper dish rack 32, the third level rack 28 is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack 28, it can be washed in the third level rack 28. The third level rack 28 generally has a much shorter height or lower profile than the upper and lower dish racks 32, 34. Typically, the height of the third level rack 28 is short enough that a typical glass cannot be stood vertically in the third level rack 28 and the third level rack 28 still be slid into the treating chamber 16.

Another dedicated dish rack can be a utensil or silverware basket (not shown), which is typically located in the treating chamber 16 and carried by one of the upper or lower dish racks 32, 34 or mounted to the door assembly 20. The silverware basket typically holds utensils and the like in an upright orientation as compared to the on-the-side or flat orientation of the third level rack 28. More than one silverware basket can be provided with the dishwasher 10.

A dispenser assembly 48 is provided to store and dispense treating chemistry, e.g. detergent, anti-spotting agent, etc., into the treating chamber 16. The dispenser assembly 48 can be mounted on an inner surface of the door assembly 20, as shown, or can be located at other positions within the chassis or treating chamber 16, such that the dispenser assembly 48 is positioned to be accessed by the user for refilling of the dispenser assembly 48, whether it is necessary to refill the dispenser assembly 48 before each cycle (i.e. for a single use dispenser) or only periodically (i.e. for a bulk dispenser). The dispenser assembly 48 can dispense one or more types of treating chemistries. The dispenser assembly 48 can be a single-use dispenser, which holds a single dose of treating chemistry, or a bulk dispenser, which holds a bulk supply of treating chemistry and which is adapted to dispense a dose of treating chemistry from the bulk supply during the cycle of operation, or a combination of both a single use and bulk dispenser. The dispenser assembly 48 can further be configured to hold multiple different treating chemistries. For example, the dispenser assembly 48 can have multiple compartments defining different chambers in which treating chemistries can be held.

Figure 2:
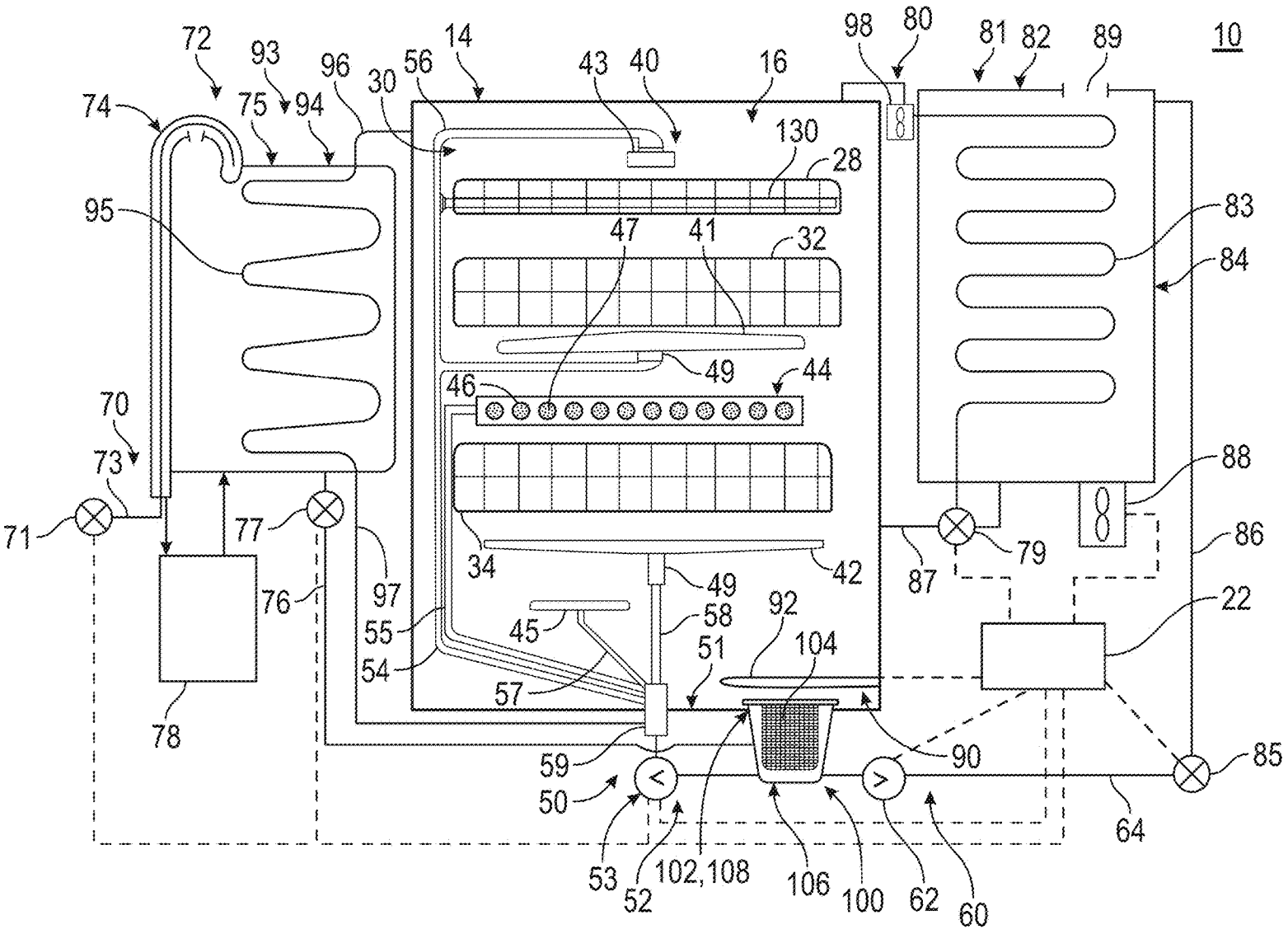
FIG. 2 is a schematic view of the dish treating appliance of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers 41, 42, 43, 44, 45, 130, some of which can be dedicated to a particular one of the dish racks, to particular area of a dish rack, to a particular type of cleaning, or to a particular level of cleaning, etc. The sprayers 41, 42, 43, 44, 45, 130 can be fixed or movable, such as rotating, relative to the treating chamber 16 or dish rack. Exemplary sprayers 41, 42, 43, 44, 45, 130 are illustrated and include an upper spray arm 41, a lower spray arm 42, a third level sprayer 43, a deep-clean sprayer 44, and a spot sprayer 45. The upper spray arm 41 and lower spray arm 42 can be rotating spray arms, located below the upper dish rack 32 and lower dish rack 34, respectively, and rotate about a generally centrally located and vertical axis. In one non-limiting example, at least one drive assembly, illustrated herein as at least one motor 49, is operably coupled to one of or to each of the upper spray arm 41 and the lower spray arm 42 in order to control and drive rotation of the lower spray arm 42. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28, though it will be understood that such a sprayer 130 can be provided adjacent any of the racks 28, 32, 34. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or can move, such as by way of rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be positioned in the lower dish rack 34 to face the deep-clean sprayer 44. The deep-clean sprayer 44, while illustrated as only one unit on a rear wall of the tub 14, could comprise multiple units and/or extend along multiple portions, including different walls, of the tub 14, and can be provided above, below, or beside any of the dish racks 28, 32, 34 wherein deep cleaning is desired.

The spot sprayer 45, like the deep-clean sprayer 44, can emit an intensified and/or higher pressure spray, especially to a discrete location within one of the dish racks 28, 32, 34. While the spot sprayer 45 is shown below the lower dish rack 34, it could be adjacent any part of any dish rack 28, 32, 34 or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as in rotating.

These sprayers 41, 42, 43, 44, 45, 130 are illustrative examples of suitable sprayers and are not meant to be limiting as to the type of suitable sprayers 41, 42, 43, 44, 45, 130. Additionally, it will be understood that not all of the exemplary sprayers 41, 42, 43, 44, 45, 130 need be included within the dishwasher 10, and that less than all of the sprayers 41, 42, 43, 44, 45, 130 described can be included in a suitable dishwasher 10.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish racks 28, 32, 34. The recirculation system 50 can include a sump 51 and a pump assembly 52. The sump 51 collects the liquid sprayed in the treating chamber 16 and can be formed by a sloped or recess portion of the bottom wall 142 of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54, 55, 56, 57, 58 to the recirculation pump 53. While each sprayer 41, 42, 43, 44, 45, 130 is illustrated as having a corresponding dedicated supply conduit 54, 55, 56, 57, 58, one or more subsets, comprising multiple sprayers from the total group of sprayers 41, 42, 43, 44, 45, 130, can be supplied by the same conduit, negating the need for a dedicated conduit 54, 55, 56, 57, 58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54, 55, 56, 57, 58 can be directly coupled to the recirculation pump 53, while one or more of the other conduits 54, 55, 56, 57, 58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated, the drain pump 62 fluidly couples the sump 51 to the drain line 64.

While separate recirculation 53 and drain pumps 62 are illustrated, a single pump can be used to perform both the recirculating and the draining functions, such as by configuring the single pump to rotate in opposite directions, or by providing a suitable valve system. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to at least some extent.

A water supply system 70 is provided for supplying fresh water to the dishwasher 10 from a water supply source, such as a household water supply via a household water valve 71. The water supply system 70 includes a water supply unit 72 having a water supply conduit 73 with a siphon break 74 or an air break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 can be provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

An air supply system 65 is provided to aid in the treating of the dishes during the cycle of operation by supplying air to at least a portion of the dishwasher 10, a non-limiting example of which includes the treating chamber 16. The air supply system 65 can include a variety of assemblies, pathways, and circuits for supplying air to different portions of the dishwasher 10 and for different purposes within the dishwasher 10, such that the air supply system 65 can be thought of as comprising all of the air supplying or air circulating portions of the dishwasher 10. In one non-limiting example, the air supply system 65 comprises a drying system 80 that is provided to aid in the drying of the dishes during the drying phase. The drying system 80 as illustrated, by way of non-limiting example, includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber 16, or a combination of both by operating in one configuration and then the other configuration. A fan or blower 98 can be fluidly coupled with the serpentine conduit 83 to move air through the serpentine conduit 83. It will also be understood that the serpentine conduit 83 is not limited to having a serpentine shape and can instead be provided with any suitable size and shape.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70, such that liquid can be supplied to the cooling tank 84. The liquid provided to the cooling tank 84 from any of the systems 40, 50, 60, 70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected based on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater 92, located in the treating chamber 16 at a location where it will be immersed by the water supplied to the treating chamber 16, such as within or near the sump 51. However, it will also be understood that the heater 92 need not be an immersion heater 92; it can also be an in-line heater located in any of the conduits. There can also be more than one heater 92, including both an immersion heater 92 and an in-line heater. The heater 92 can also heat air contained in the treating chamber 16. Alternatively, a separate heating element (not shown) can be provided for heating the air circulated through the treating chamber 16.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated, such as an ultrafiltration system.

Figure 3:
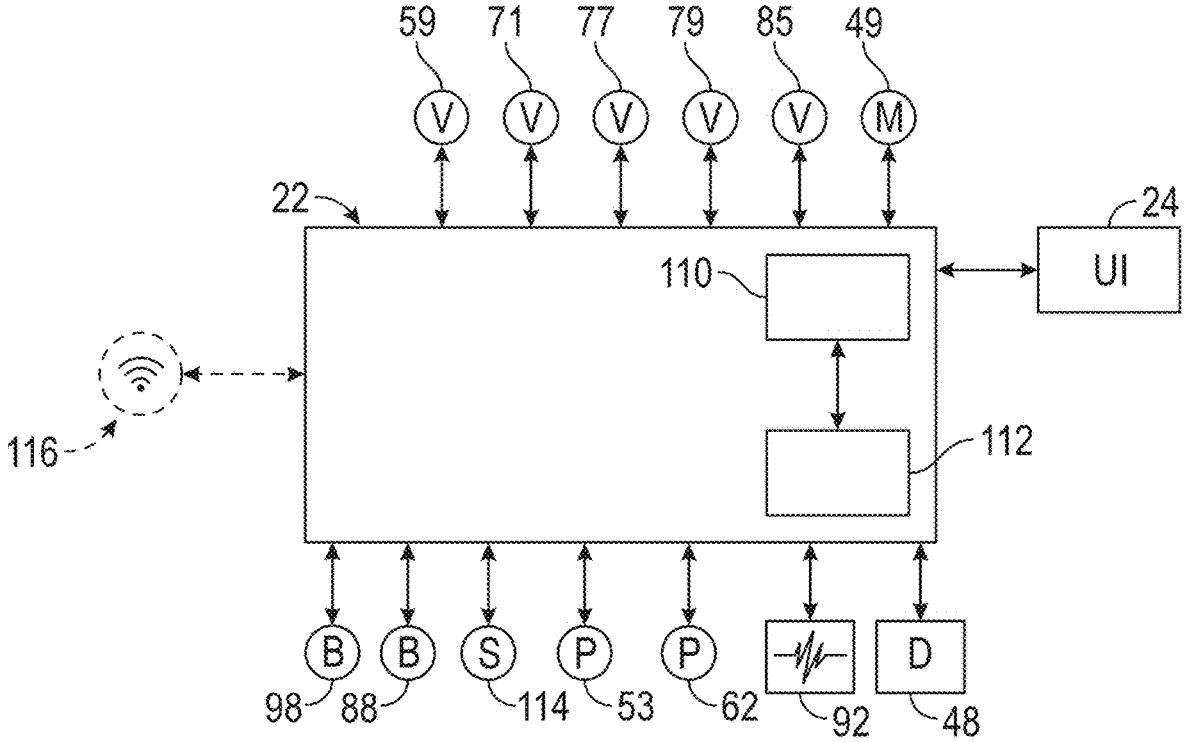
FIG. 3 is a schematic view of a controller of the dish treating appliance of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, the recirculation pump 53 for recirculating the wash liquid during the cycle of operation, the user interface 24 for receiving user selected inputs and communicating information to the user, the dispenser assembly 48 for selectively dispensing treating chemistry to the treating chamber 16, the at least one motor 49 for selectively actuating rotation of the upper spray arm 41 and/or the lower spray arm 42, the blower 98 for providing air through the serpentine conduit 83, and the blower 88 for providing air into the cooling tank 84. The controller 22 can also communicate with the recirculation valve 59, the household water valve 71, the controllable valve 77, the return valve 79, and the valve 85 to selectively control the flow of liquid within the dishwasher 10. Optionally, the controller 22 can include or communicate with a wireless communication device 116.

The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store a set of executable instructions including one or more pre-programmed automatic cycles of operation that can be selected by a user and executed by the dishwasher 10. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 24. The memory 110 can also be used to store information, such as a database or table, and to store data received from one or more components of the dishwasher 10 that can be communicably coupled with the controller 22. The database or table can be used to store the various operating parameters for the one or more cycles of operation, including factory default values for the operating parameters and any adjustments to them by the control assembly or by user input.

The controller 22 can also receive input from one or more sensors 114 provided in one or more of the assemblies or systems of the dishwasher 10 to receive input from the sensors 114, which are known in the art and not shown for simplicity. Non-limiting examples of sensors 114 that can be communicably coupled with the controller 22 include, to name a few, an ambient air temperature sensor, a treating chamber temperature sensor, such as a thermistor, a water supply temperature sensor, a door open/close sensor, a moisture sensor, a chemical sensor, and a turbidity sensor to determine the soil load associated with a selected grouping of dishes, such as the dishes associated with a particular area of the treating chamber 16.

Figure 4:
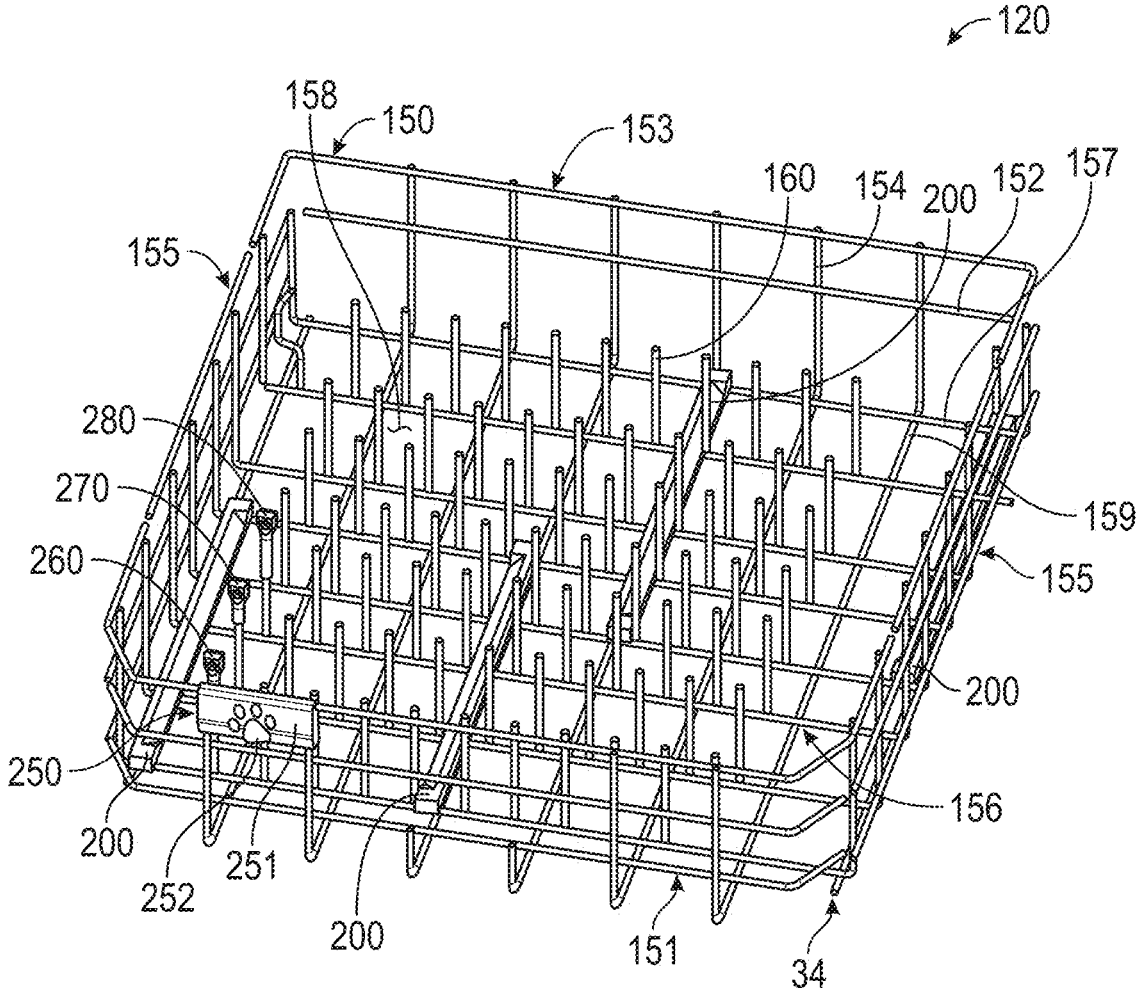
FIG. 4 illustrates a top perspective view of a dish rack assembly with loading zone markers, including examples of tine markers, rack bottom markers, and a rack wall marker, according to an aspect of the present disclosure and for use with the dish treating appliance of FIGS. 1-3.

Turning now to FIG. 4, a perspective view of a dish rack assembly 120 comprising the lower dish rack 34 is illustrated. It will be understood that the lower dish rack 34 and upper dish rack 32 can be formed in any suitable manner and are not limited to the illustrated shapes and structures. In the illustrated example, a perimeter wall 150, comprising a plurality of cross members 152 and vertical members 154, extending upwardly from a bottom wall, shown as a floor latticework 156, to define an interior 158 of the lower dish rack 34. The perimeter wall 150 can be thought of as comprising a front wall 151, a rear wall 153, and opposing side walls 155. The floor latticework 156 comprises intersecting first members 157 and second members 159. While the first members 157 are illustrated herein as extending across a width of the lower dish rack 34 and the second members 159 are illustrated herein as extending across a length or depth of the lower dish rack 34, it will be understood that these orientations are not limiting. The floor latticework 156 can further define contoured portions (not shown) of the floor latticework 156 that can extend upwardly or downwardly to aid in positioning the various shapes and sizes of dishes within the lower dish rack 34. Further still, a plurality of positioning tines 160 can extend upwardly from the floor latticework 156 into the interior 158 to aid in positioning of dish items.

The dish rack assembly 120 further comprises at least one loading zone marker provided with the dish rack assembly 120, the at least one loading zone marker illustrated herein as comprising at least one of a rack bottom marker 200, a rack wall marker 250, and a tine marker 260, 270, 280. The rack bottom markers 200 are illustrated herein as pairs of opposing, spaced apart rack bottom markers 200 that at least partially define a loading zone therebetween. While the dish rack assembly 120 is illustrated herein as including two pairs of rack bottom markers 200, it will be understood that the dish rack assembly 120 can include any suitable number of rack bottom markers 200, including a single pair of rack bottom markers 200. The rack bottom markers 200 are coupled to the floor latticework 156 by any suitable method, non-limiting examples of which can include snap attachment, attachment by a fastener, or overmolding about the floor latticework 156. The rack bottom markers 200 can have any suitable color for indicating a specific loading zone, and/or can include an indicia (not shown) identifying the loading zone.

The rack wall marker 250 comprises a rack attachment base 251 coupled with the perimeter wall 150 in alignment with a portion of the dish rack assembly 120 included in the loading zone, and optionally including an indicia 252 indicative of the target loading zone. In the illustrated example, the indicia 252 is provided as a paw print, which can indicate a target loading zone for pet items, such as food or water bowls, to be washed within the dish rack assembly 120, though it will be understood that any suitable indicia 252 can be used. While the rack wall marker 250 is illustrated herein as being provided with the front wall 151 of the dish rack assembly 120, it will be understood that any suitable location on the perimeter wall 150 can be used. The rack wall marker 250 can also function as a handle for the lower dish rack 34, or can be provided separately from and in addition to a rack handle.

The tine markers 260, 270, 280 are provided on individual tines 160 of the lower dish rack 34 and can indicate which tines 160 or rows of tines 160 are included within the loading zone. Any suitable number of tine markers 260, 270, 280 can be provided, including only a single tine marker 260, 270, 280. The tine markers 260, 270, 280 are coupled to the tines 160 by any suitable method, non-limiting examples of which can include snap attachment, attachment by a fastener, or overmolding about the tines 160. The tine markers 260, 270, 280 can have any suitable color for indicating a specific loading zone, and/or can include an indicia (FIG. 5) identifying the loading zone.

While the dish rack assembly 120 is illustrated herein as including each of the rack bottom marker 200, the rack wall marker 250, and the tine markers 260, 270, 280, it will be understood that only rack bottom markers 200, rack wall markers 250, or tine markers 260, 270, 280 may be included individually, or in any other combination with other types of loading zone markers 200, 250, 260, 270, 280. While only the lower dish rack 34 is illustrated herein as including the loading zone markers 200, 250, 260, 270, 280 and forming a part of the dish rack assembly 120, it will be understood that either or both of the upper dish rack 32 or the lower dish rack 34 can be included as part of the dish rack assembly 120 and can include the at least one loading zone marker 200, 250, 260, 270, 280. Further, it will be understood that the dishwasher 10 can include more than one loading zone as indicated or delineated by the at least one loading zone marker 200, 250, 260, 270, 280. Further still, the at least one loading zone marker 200, 250, 260, 270, 280 can be provided within the upper dish rack 32 or the lower rack 34, or both.

Figure 5:
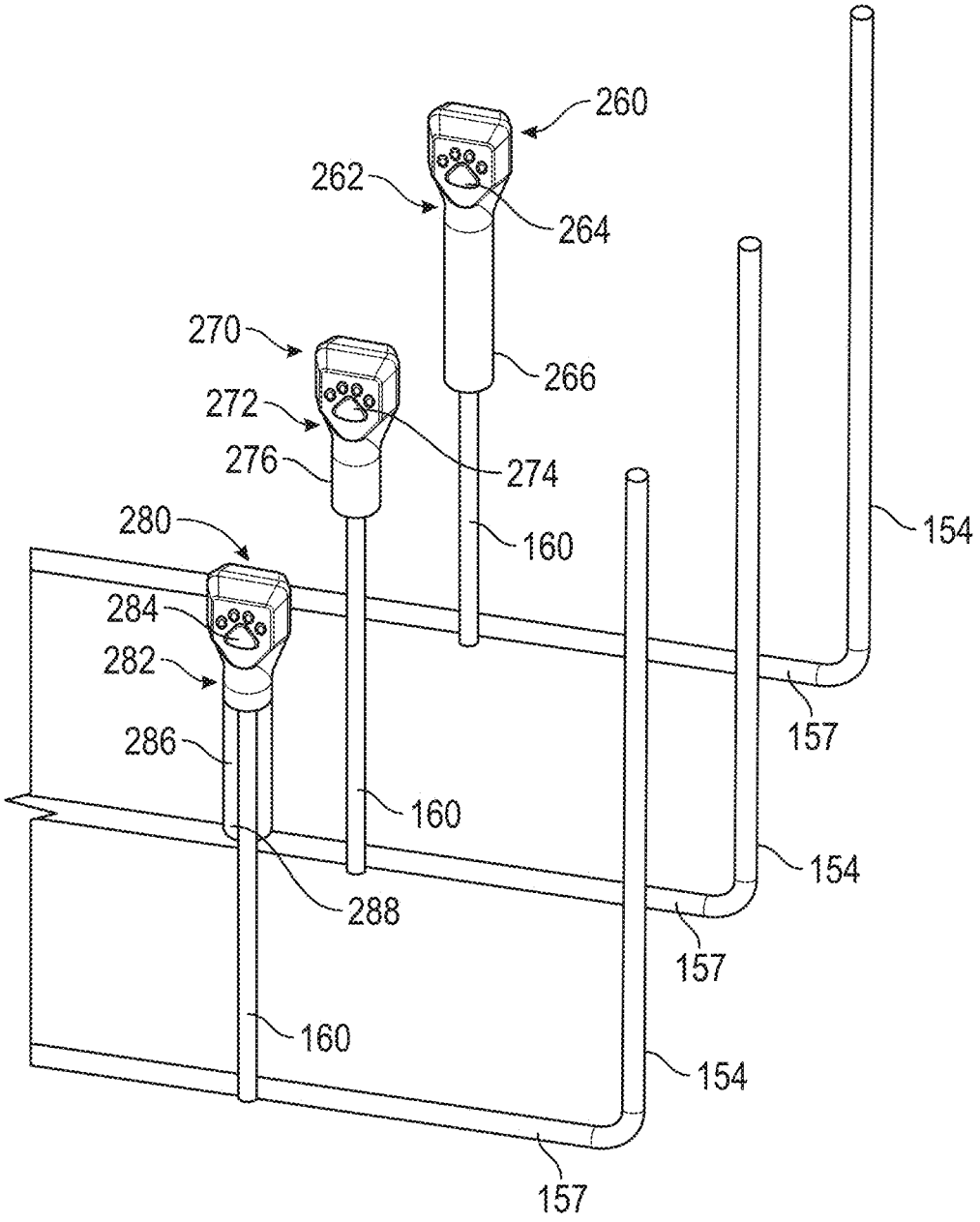
FIG. 5 illustrates an enlarged perspective view of the loading zone tine markers of FIG. 4.

Turning now to the enlarged view of the tine markers 260, 270, 280 illustrated in FIG. 5, it can be better seen that each of the tine markers 260, 270, 280 comprises a body 262, 272, 282 coupling the tine marker 260, 270, 280 to one of the tines 160, the body 262, 272, 282 optionally carrying an indicia 264, 274, 284 indicative of the type of dish items to be placed in the target loading zone. The bodies 262, 272, 282 can have a variety of shapes or configurations for coupling with the tine 160. By way of non-limiting example, the body 262 of the tine marker 260 comprises a long cylindrical collar 266 provided about the tine 160, the body 272 of the tine marker 270 comprises a short cylindrical collar 276 provided about the tine 160, and the body 282 of the tine marker 280 comprises a long C-shaped collar 286 provided about the tine 160 and defining a gap 288 extending along the tine 160, such as to allow the tine marker 280 to be snapped on or off of the tine 160. It will also be understood that, while the dish rack assembly 120 is illustrated herein as including the three tine markers 260, 270, 280, any suitable number of tine markers 260, 270, 280 can be provided, including only a single tine marker 260, 270, 280.

Figure 6:
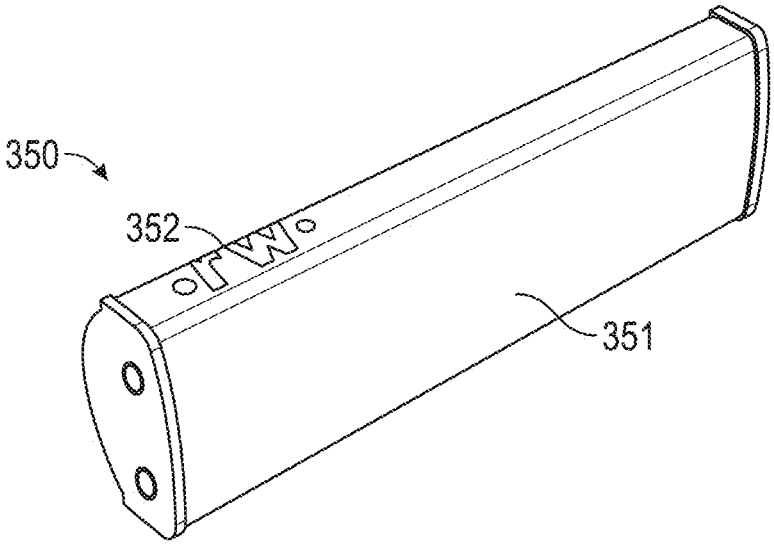
FIG. 6 illustrates a perspective view of another example of a loading zone rack wall marker for use with the dish rack assembly of FIG. 4.

FIG. 6 illustrates another example of a rack wall marker 350 for use with the dish rack assembly 120 and the dishwasher 10 described herein that is similar to the rack wall marker 250 of FIG. 4, and shares many of the same features and components as the rack wall marker 250, but differs in some aspects, such as in the position of an indicia 352. Therefore, elements of the rack wall marker 350 that are similar to those of the rack wall marker 250 are identified with numerals increased by 100, with it being understood that the description of the like parts of the rack wall marker 250 applies to the rack wall marker 350, unless otherwise noted.

The rack wall marker 350 is similar to the rack wall marker 250 in most aspects, such as in the inclusion of a rack attachment base 351 and the indicia 352, but differs from the rack wall marker 250 in the position and identity of the indicia 352 on the rack attachment base 351. In addition, by way of non-limiting example, the rack attachment base 351 also defines and serves as a handle by which a user can grip and push or pull the dish rack assembly 120.

Figure 7:
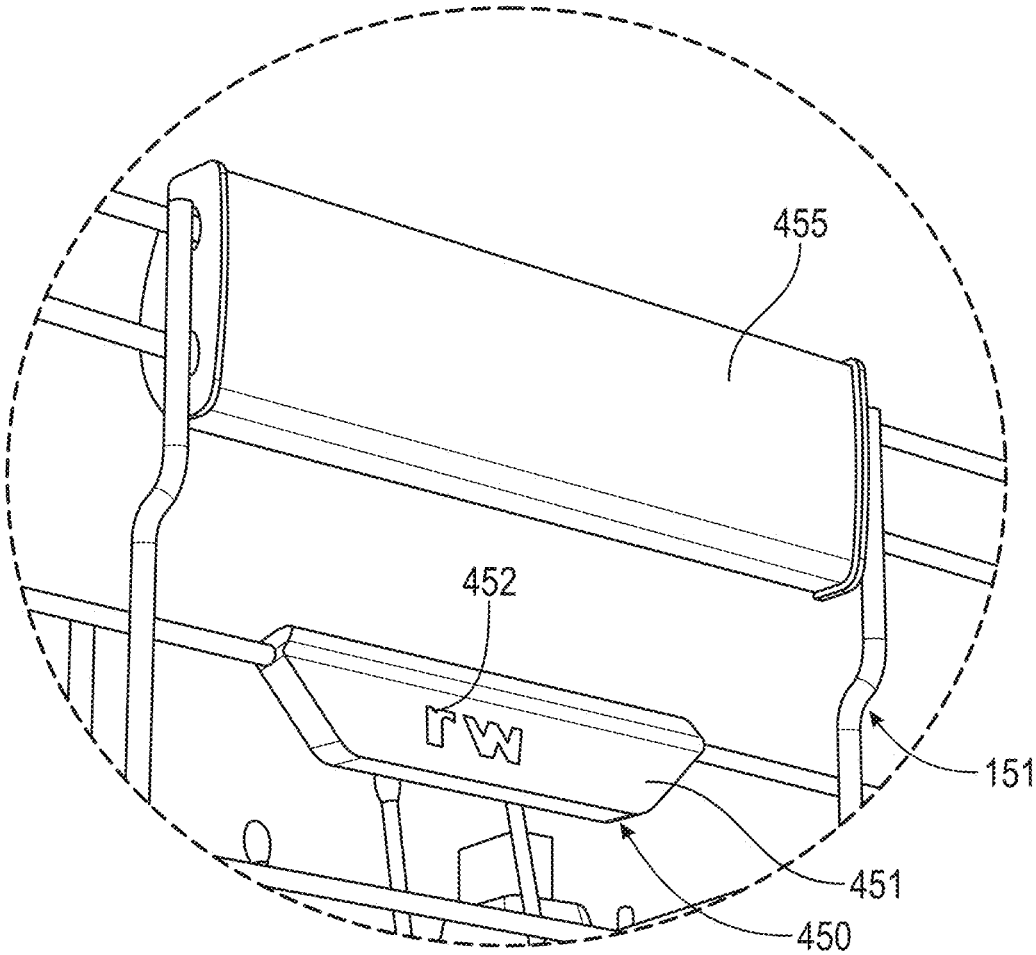
FIG. 7 illustrates a perspective view of yet another example of a loading zone rack wall marker for use with the dish rack assembly of FIG. 4.

FIG. 7 illustrates yet another example of a rack wall marker 450 for use with the dish rack assembly 120 and the dishwasher 10 described herein that is similar to the rack wall marker 250 of FIG. 4, and shares many of the same features and components as the rack wall marker 250, but differs in some aspects, such as in the position of a rack attachment base 451. Therefore, elements of the rack wall marker 450 that are similar to those of the rack wall marker 250 are identified with numerals increased by 200, with it being understood that the description of the like parts of the rack wall marker 250 applies to the rack wall marker 450, unless otherwise noted.

The rack wall marker 450 is similar to the rack wall marker 250 in most aspects, such as in the inclusion of a rack attachment base 451 and the indicia 452, but differs from the rack wall marker 250 in the position and identity of the indicia 452 on the rack attachment base 451. In addition, by way of non-limiting example, the rack attachment base 451 is provided separate from, but also adjacent to, a handle 455 by which a user can grip and push or pull the dish rack assembly 120 via the front wall 151.

Figure 8:
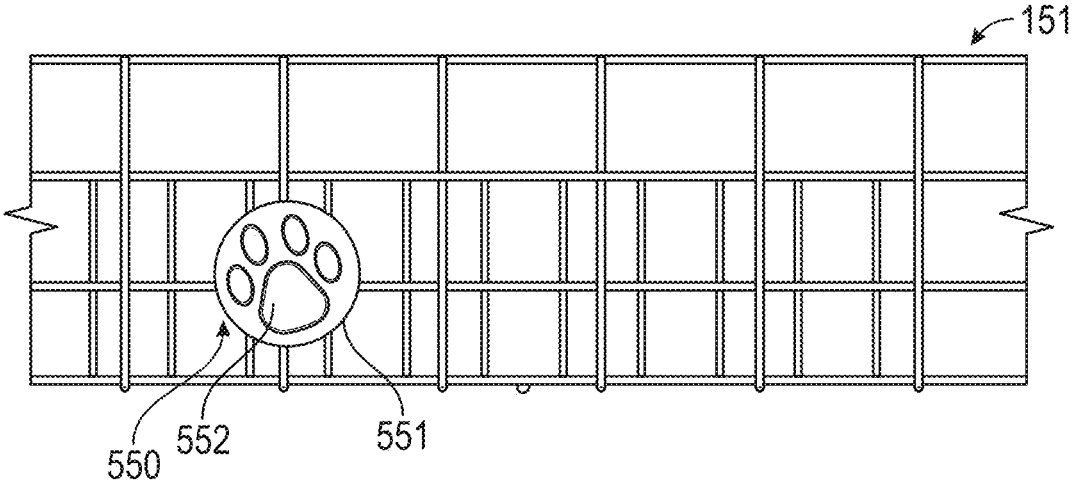
FIG. 8 illustrates a front view of yet another example of a loading zone rack wall marker for use with the dish rack assembly of FIG. 4.

FIG. 8 illustrates yet another example of a rack wall marker 550 for use with the dish rack assembly 120 and the dishwasher 10 described herein that is similar to the rack wall marker 250 of FIG. 4, and shares many of the same features and components as the rack wall marker 250, but differs in some aspects, such as in the position of an indicia 552 and shape of a rack attachment base 551. Therefore, elements of the rack wall marker 550 that are similar to those of the rack wall marker 250 are identified with numerals increased by 300, with it being understood that the description of the like parts of the rack wall marker 250 applies to the rack wall marker 550, unless otherwise noted.

The rack wall marker 550 is similar to the rack wall marker 250 in most aspects, such as in the inclusion of a rack attachment base 551 and the indicia 552, but differs from the rack wall marker 250 in the position and identity of the indicia 552 on the rack attachment base 551, as well as in the shape of the rack attachment base 551. In addition, by way of non-limiting example, the rack attachment base 551 is positioned lower on the front wall 151 than the rack wall marker 250, such that it would be separate from a handle for the dish rack assembly 120.

Figure 9:
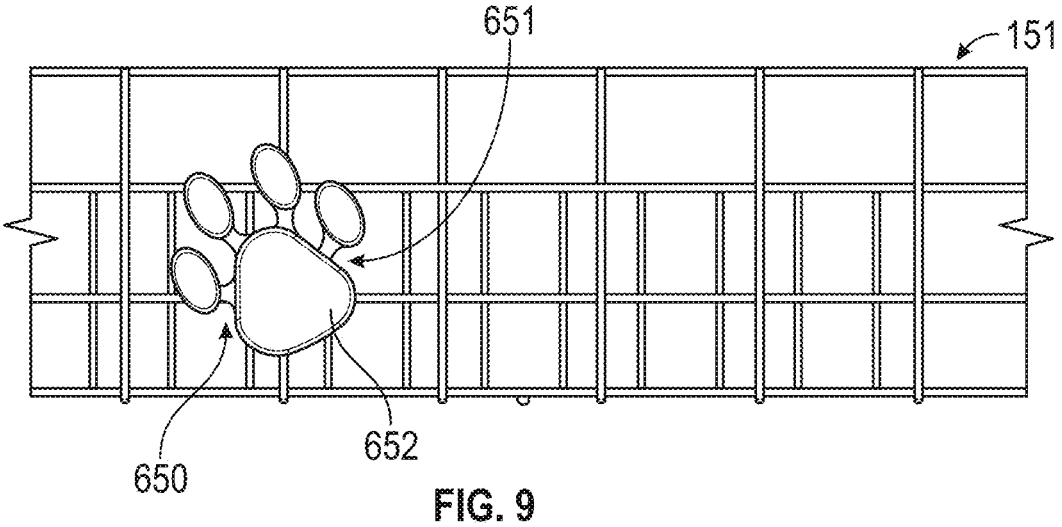
FIG. 9 illustrates a front view of yet another example of a loading zone rack wall marker for use with the dish rack assembly of FIG. 4.

FIG. 9 illustrates yet another example of a rack wall marker 650 for use with the dish rack assembly 120 and the dishwasher 10 described herein that is similar to the rack wall marker 250 of FIG. 4, and shares many of the same features and components as the rack wall marker 250, but differs in some aspects, such as in the rack wall marker 650 having a single body defining both an indicia 652 and a rack attachment base 651. Therefore, elements of the rack wall marker 650 that are similar to those of the rack wall marker 250 are identified with numerals increased by 400, with it being understood that the description of the like parts of the rack wall marker 250 applies to the rack wall marker 650, unless otherwise noted.

The rack wall marker 650 is similar to the rack wall marker 250 in most aspects, such as in the inclusion of a rack attachment base 651 and the indicia 652, but differs from the rack wall marker 250 in the relationship between the indicia 652 and the rack attachment base 651, as well as in the shape of the rack attachment base 651. In the rack wall marker 650, rather than the indicia 652 and the rack attachment base 651 having different shapes, the indicia 652 itself defines its own shape and includes the rack attachment base 651, such as by inclusion of a fastening or attachment feature (not shown) on a rear surface of the indicia 652. In addition, by way of non-limiting example, the rack attachment base 651 is positioned lower on the front wall 151 than the rack wall marker 250, such that it would be separate from a handle for the dish rack assembly 120.

Figure 10:
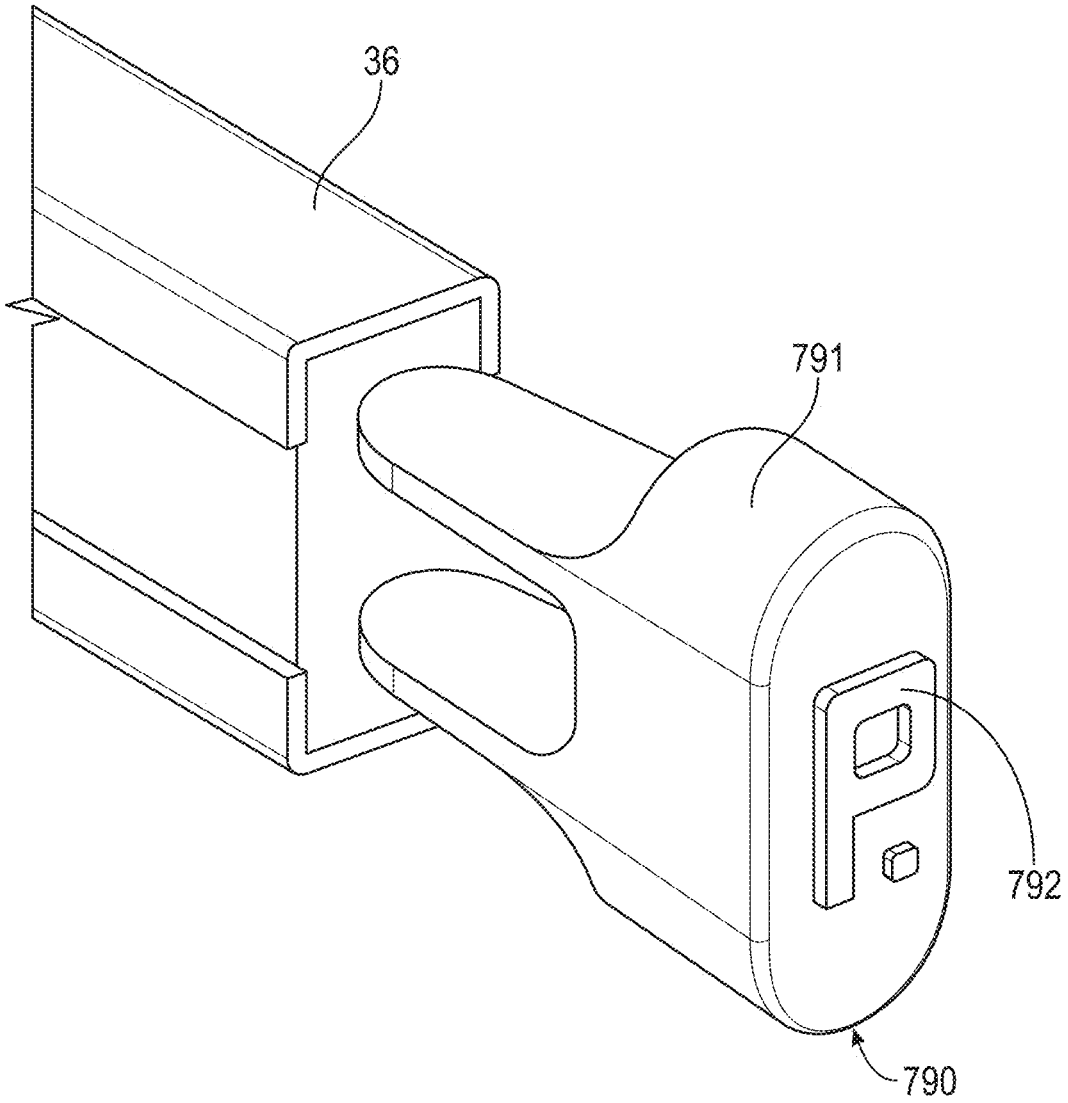
FIG. 10 illustrates a perspective view of another example of a loading zone marker for use with a dish rack assembly of the dish treating appliance of FIGS. 1-3.

FIG. 10 illustrates another example of a loading zone marker for use with the dish rack assembly 120 and the dishwasher 10 described herein, provided as a rail marker 790. Similar to the rack wall markers 250, 350, 450, 550, 650, the rail marker 790 comprises a body 791 optionally including an indicia 792 indicative of the target loading zone. However, instead of coupling directly to the dish rack assembly 120, the rail marker 790 instead couples to the rail 36, 39 of the upper or lower dish racks 32, 34. By way of non-limiting example, the rail marker 790 can be provided with the rail 36, 39 along only one side of the dish rack assembly 120, such as to indicate which side of the dish rack assembly 120 forms the target loading zone, or the rail marker 790 can be provided with both of the opposing rails 36 and/or both of the opposing rails 39, along both sides of the dish rack assembly 120, such as to indicate which of the dish racks 32, 34 forms the target loading zone.

Figure 11:
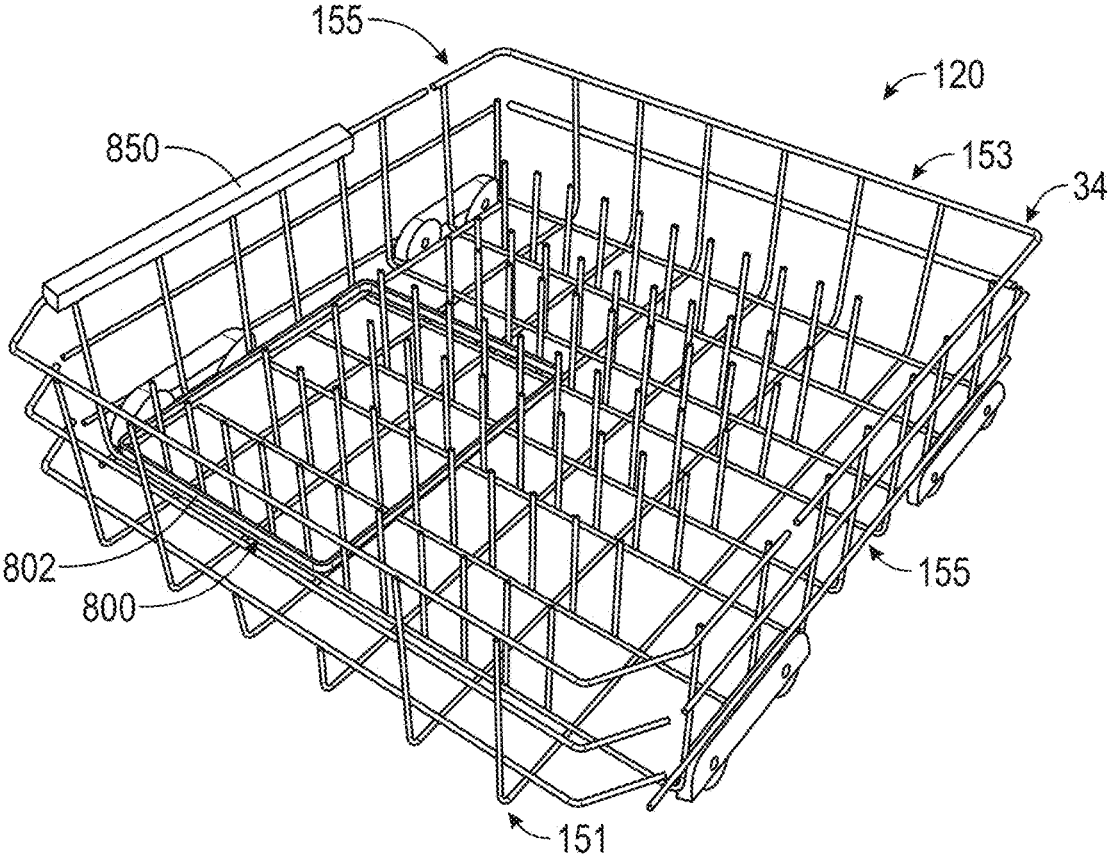
FIG. 11 illustrates a perspective view of the dish rack assembly of FIG. 4 and including another example of a loading zone rack bottom marker and a loading zone rack wall marker for use with the dish rack assembly.

FIG. 11 illustrates other examples of a rack bottom marker 800 and a rack wall marker 850 for use with the dish rack assembly 120 and the dishwasher 10 described herein that are similar to the rack bottom marker 200 and rack wall marker 250 of FIG. 4, and share many of the same features and components as the rack bottom marker 200 and rack wall marker 250, but differ in some aspects, such as in the rack bottom marker 800 having a single, continuous body 802, rather than being provided as a pair of spaced apart, opposing rack bottom markers 200, and in the position of the rack wall marker 850 relative to the dish rack assembly 120. Therefore, elements of the rack bottom marker 800 and the rack wall marker 850 that are similar to those of the rack bottom marker 200 and the rack wall marker 250 are identified with numerals increased by 600, with it being understood that the description of the like parts of the rack bottom marker 200 and the rack wall marker 250 apply to the rack bottom marker 800 and the rack wall marker 850, unless otherwise noted.

While the rack bottom marker 200 was provided as a pair of rack bottom markers 200, the rack bottom marker 800 is a single continuous and monolithic body 802 that forms an outline of a portion of the floor latticework 156 defining the loading zone. The rack bottom marker 800 can simply rest upon the floor latticework 156, such as by being held in place by the tines 160 that the rack bottom marker 800 surrounds, and/or the rack bottom marker 800 can be coupled to the floor latticework 156 by any suitable method, non-limiting examples of which can include snap attachment, attachment by a fastener, or overmolding about the floor latticework 156. The rack bottom marker 800 can have any suitable color for indicating a specific loading zone, and/or can include an indicia (not shown) identifying the loading zone.

While the rack wall marker 250 was provided on the front wall 151 of the dish rack assembly 120, the rack wall marker 850 can be provided on one of the side walls 155 of the dish rack assembly 120. In one example, the length of the side wall 155 along which the rack wall marker 850 extends can be coextensive with the rack bottom marker 800, though it will be understood that the rack wall marker 850 can be provided without the inclusion of the rack bottom marker 800, and vice versa. The rack wall marker 850 can be coupled to the side wall 155 by any suitable method, non-limiting examples of which can include snap attachment, attachment by a fastener, or overmolding about the first and/or second members 157, 159. The rack wall marker 850 can have any suitable color for indicating a specific loading zone, and/or can include an indicia (not shown) identifying the loading zone.

Figure 12:
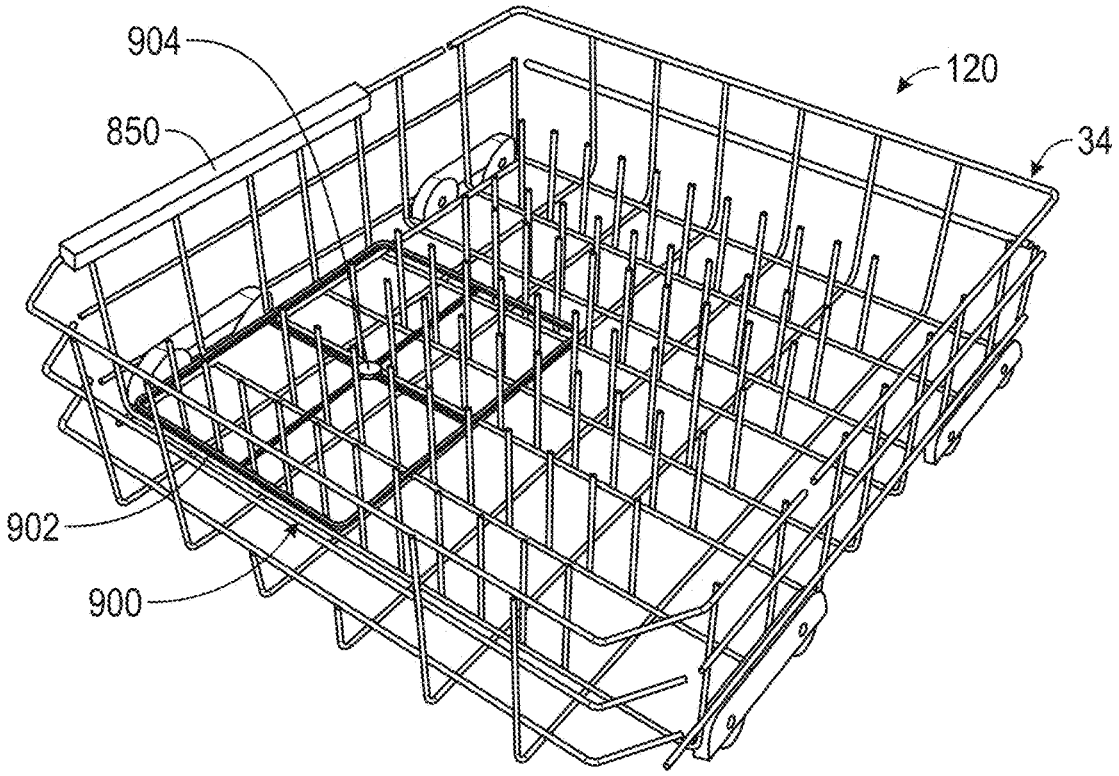
FIG. 12 illustrates a perspective view of the dish rack assembly of FIG. 4 and including another example of a loading zone rack bottom marker for use with the dish rack assembly.

FIG. 12 illustrates yet another example of a rack bottom marker 900 for use with the dish rack assembly 120 and the dishwasher 10 described herein that is similar to the rack bottom marker 800 of FIG. 11, and shares many of the same features and components as the rack bottom marker 800, but differs in some aspects, such as in the rack bottom marker 900 having additional frame elements. Therefore, elements of the rack bottom marker 900 that are similar to those of the rack bottom marker 800 are identified with numerals increased by 100, with it being understood that the description of the like parts of the rack bottom marker 800 applies to the rack bottom marker 900, unless otherwise noted.

The rack bottom marker 900 is similar to the rack bottom marker 800 in most aspects, such as in the inclusion of a body 902 forming an outline of a portion of the floor latticework 156 defining the loading zone, but differs from the rack bottom marker 800 in that the rack bottom marker 900 includes additional frame elements, illustrated herein as an interior grid 904, provided with the body 902. The interior grid 904 can be provided to further delineate the loading zone, and/or to further sub-divide the loading zone into smaller sub-areas for specific types of dish items. While the rack bottom marker 900 is shown herein alongside the rack wall marker 850, it will be understood that the rack bottom marker 900 can be used on its own, without the rack wall marker 850, and vice versa.

Figure 13:
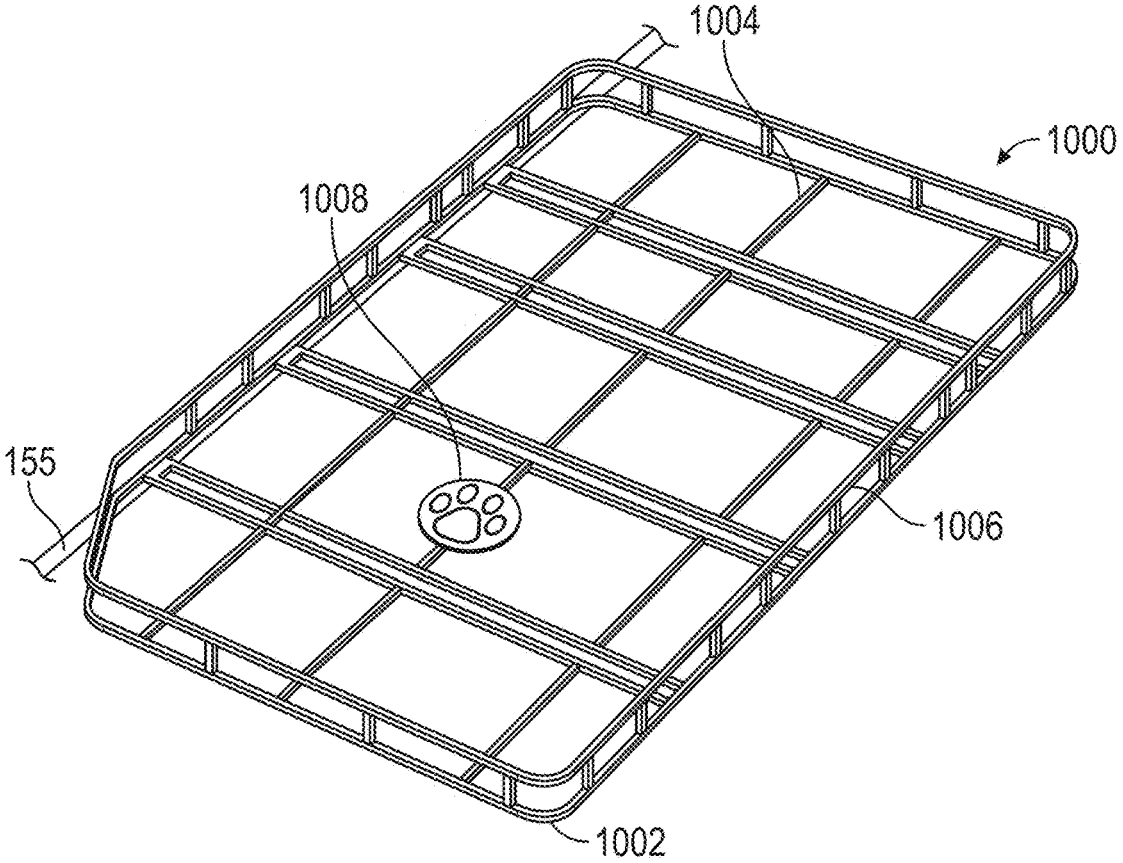
FIG. 13 illustrates a perspective view of another example of a loading zone rack bottom marker for use with the dish rack assembly of FIG. 4.

FIG. 13 illustrates yet another example of a rack bottom marker 1000 for use with the dish rack assembly 120 and the dishwasher 10 described herein that is similar to the rack bottom marker 900 of FIG. 12, and shares many of the same features and components as the rack bottom marker 900, but differs in some aspects, such as in the rack bottom marker 1000 having additional frame elements. Therefore, elements of the rack bottom marker 1000 that are similar to those of the rack bottom marker 900 are identified with numerals increased by 100, with it being understood that the description of the like parts of the rack bottom marker 900 applies to the rack bottom marker 1000, unless otherwise noted.

The rack bottom marker 1000 is similar to the rack bottom marker 900 in most aspects, such as in the inclusion of a body 1002 forming an outline of a portion of the floor latticework 156 defining the loading zone, and in the inclusion of an interior grid 1004, but differs from the rack bottom marker 900 in that the rack bottom marker 1000 includes additional frame elements, illustrated herein as a sidewall 1006 extending upwardly from the body 1002, and that the body 1002 overall is formed more as a tray within the dish rack assembly 120 than simply an outlining portion. By way of non-limiting example, the sidewall 1006 is illustrated herein as a continuous sidewall 1006, though it will be understood that the sidewall 1006 need not be continuous about the entirety of the body 1002. In addition, the rack bottom marker 1000 is illustrated as including an indicia 1008. While the indicia 1008 is provided on the interior grid 1004, it will be understood that such position is not limiting and the indicia 1008 can be positioned at any suitable location on the rack bottom marker 900, including on the sidewall 1006. The rack bottom marker 1000 can simply rest upon the floor latticework 156, such as by being held in place by the tines 160 that the rack bottom marker 1000 surrounds, and/or the rack bottom marker 1000 can be coupled to the floor latticework 156 by any suitable method, non-limiting examples of which can include snap attachment, attachment by a fastener, or overmolding about the floor latticework 156.

FIG. 13 illustrates yet another example of a rack bottom marker 1000 for use with the dish rack assembly 120 and the dishwasher 10 described herein that is similar to the rack bottom marker 900 of FIG. 12, and shares many of the same features and components as the rack bottom marker 900, but differs in some aspects, such as in the rack bottom marker 1000 having additional frame elements. Therefore, elements of the rack bottom marker 1000 that are similar to those of the rack bottom marker 900 are identified with numerals increased by 100, with it being understood that the description of the like parts of the rack bottom marker 900 applies to the rack bottom marker 1000, unless otherwise noted.

The rack bottom marker 1000 is similar to the rack bottom marker 900 in most aspects, such as in the inclusion of a body 1002 forming an outline of a portion of the floor latticework 156 defining the loading zone, and in the inclusion of an interior grid 1004, but differs from the rack bottom marker 900 in that the rack bottom marker 1000 includes additional frame elements, illustrated herein as a sidewall 1006 extending upwardly from the body 1002, and that the body 1002 overall is formed more as a tray within the dish rack assembly 120 than simply an outlining portion. By way of non-limiting example, the sidewall 1006 is illustrated herein as a continuous sidewall 1006, though it will be understood that the sidewall 1006 need not be continuous about the entirety of the body 1002. In addition, the rack bottom marker 1000 is illustrated as including an indicia 1008. While the indicia 1008 is provided on the interior grid 1004, it will be understood that such position is not limiting and the indicia 1008 can be positioned at any suitable location on the rack bottom marker 900, including on the sidewall 1006. The rack bottom marker 1000 can simply rest upon the floor latticework 156, such as by being held in place by the tines 160 that the rack bottom marker 1000 surrounds, and/or the rack bottom marker 1000 can be coupled to the floor latticework 156 by any suitable method, non-limiting examples of which can include snap attachment, attachment by a fastener, or overmolding about the floor latticework 156. It will also be understood that the rack bottom marker 1000 can be removable from the dish rack assembly 120, such as for ease of loading and unloading dish items.

Figure 14:
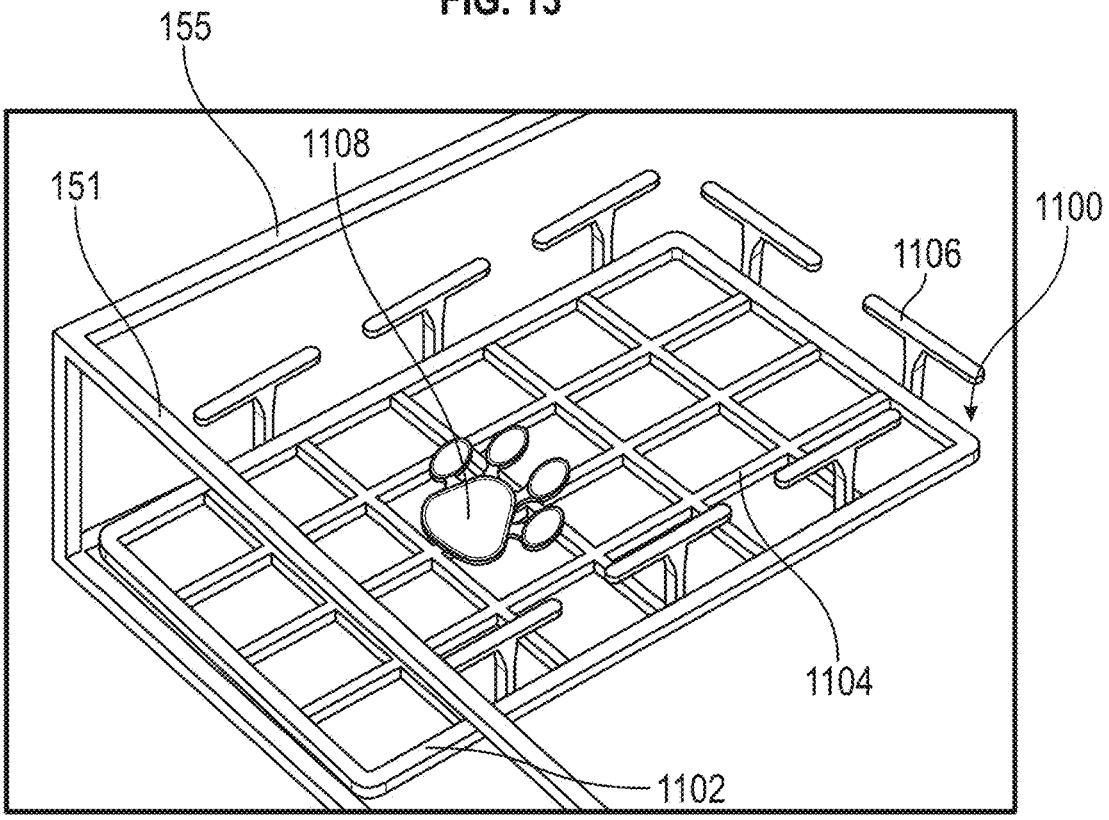
FIG. 14 illustrates a perspective view of another example of a loading zone rack bottom marker for use with the dish rack assembly of FIG. 4.

FIG. 14 illustrates yet another example of a rack bottom marker 1100 for use with the dish rack assembly 120 and the dishwasher 10 described herein that is similar to the rack bottom marker 1000 of FIG. 13, and shares many of the same features and components as the rack bottom marker 1000, but differs in some aspects, such as in the structure of the sidewall 1106. Therefore, elements of the rack bottom marker 1100 that are similar to those of the rack bottom marker 1000 are identified with numerals increased by 100, with it being understood that the description of the like parts of the rack bottom marker 1000 applies to the rack bottom marker 1100, unless otherwise noted.

The rack bottom marker 1100 is similar to the rack bottom marker 1000 in most aspects, such as in the inclusion of a body 1102 forming a tray defining an outline of a portion of the floor latticework 156 defining the loading zone, and in the inclusion of an interior grid 1104, sidewall 1106, and indicia 1108, but differs from the rack bottom marker 1000 in that the rack bottom marker 1100 has a discontinuous sidewall 1106, as opposed to the continuous sidewall 1006 of the rack bottom marker 1000. In this way, the sidewall 1106 can be thought of as a discontinuous sidewall 1106 or can be thought of as comprising individual, spaced sidewall portions 1106, the size and spacing of which are illustrated herein only by way of non-limiting example. The rack bottom marker 1100 can simply rest upon the floor latticework 156, such as by being held in place by the tines 160 that the rack bottom marker 1100 surrounds when in place within the dish rack assembly 120, and/or the rack bottom marker 1100 can be coupled to the floor latticework 156 by any suitable method, non-limiting examples of which can include snap attachment, attachment by a fastener, or overmolding about the floor latticework 156. It will also be understood that the rack bottom marker 1100 can be removable from the dish rack assembly 120, such as for ease of loading and unloading dish items.

Figure 15:
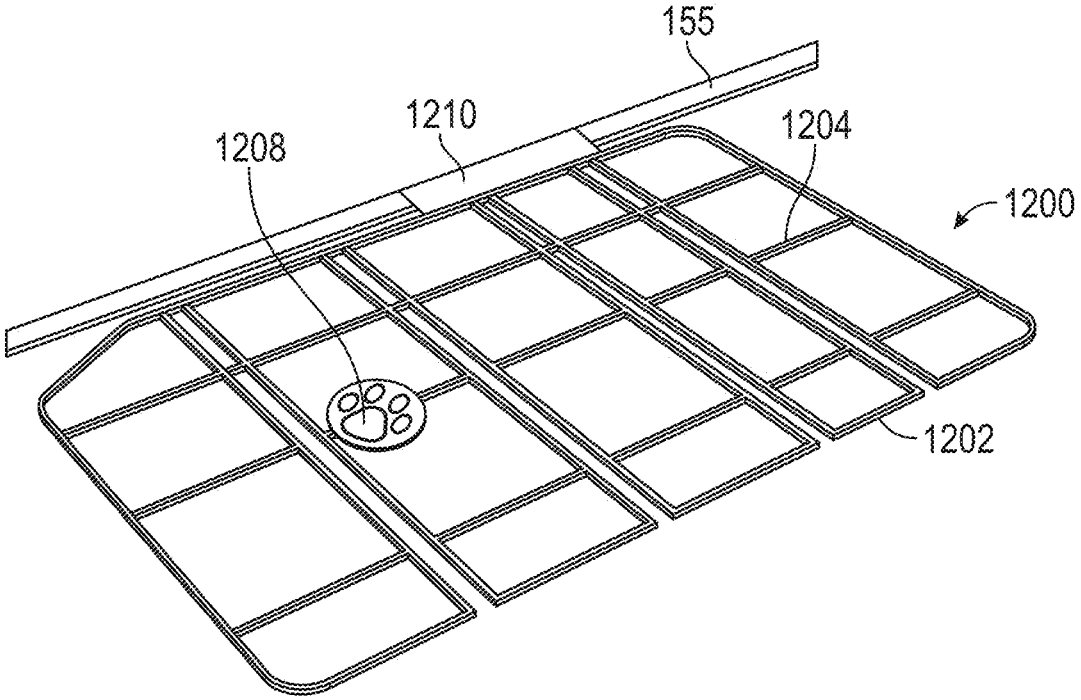
FIG. 15 illustrates a perspective view of another example of a loading zone marker for use with the dish rack assembly of FIG. 4.

FIG. 15 illustrates yet another example of a rack bottom marker 1200 for use with the dish rack assembly 120 and the dishwasher 10 described herein that is similar to the rack bottom marker 1000 of FIG. 13, and shares many of the same features and components as the rack bottom marker 1000, but differs in some aspects, such as in that the rack bottom marker 1200 does not include the sidewall 1006 as in the rack bottom marker 1000, and also in that the rack bottom marker 1200 can be movably coupled with the dish rack assembly 120. Therefore, elements of the rack bottom marker 1200 that are similar to those of the rack bottom marker 1000 are identified with numerals increased by 200, with it being understood that the description of the like parts of the rack bottom marker 1000 applies to the rack bottom marker 1200, unless otherwise noted.

The rack bottom marker 1200 is similar to the rack bottom marker 1000 in most aspects, such as in the inclusion of a body 1202 forming a tray defining an outline of a portion of the floor latticework 156 defining the loading zone, and in the inclusion of an interior grid 1204 and indicia 1208, but differs from the rack bottom marker 1000 in that the rack bottom marker 1200 has no sidewall. Further, rather than simply being removably fixed to or resting upon the floor latticework 156, the rack bottom marker 1200 can be movably coupled to the dish rack assembly. By way of non-limiting example, the rack bottom marker 1200 can be rotatably coupled with the dish rack assembly by a hinge 1210, such as by the hinge 1210 rotatably coupling the rack bottom marker 1200 with the sidewall 155 or with a second member 159 of the floor latticework 156. Further, the hinge 1210 can rotatably couple the rack bottom marker 1200 either at a lower portion of the sidewall 155 or at an upper edge of the sidewall 155. The hinge 1210 can be coupled to the dish rack 34 by any suitable method, non-limiting examples of which can include snap attachment, attachment by a fastener, or overmolding about the dish rack 34. It will also be understood that the rack bottom marker 1200, and specifically the hinge 1210, can be removable from the dish rack 34, such as for ease of loading and unloading dish items.

Figure 16:
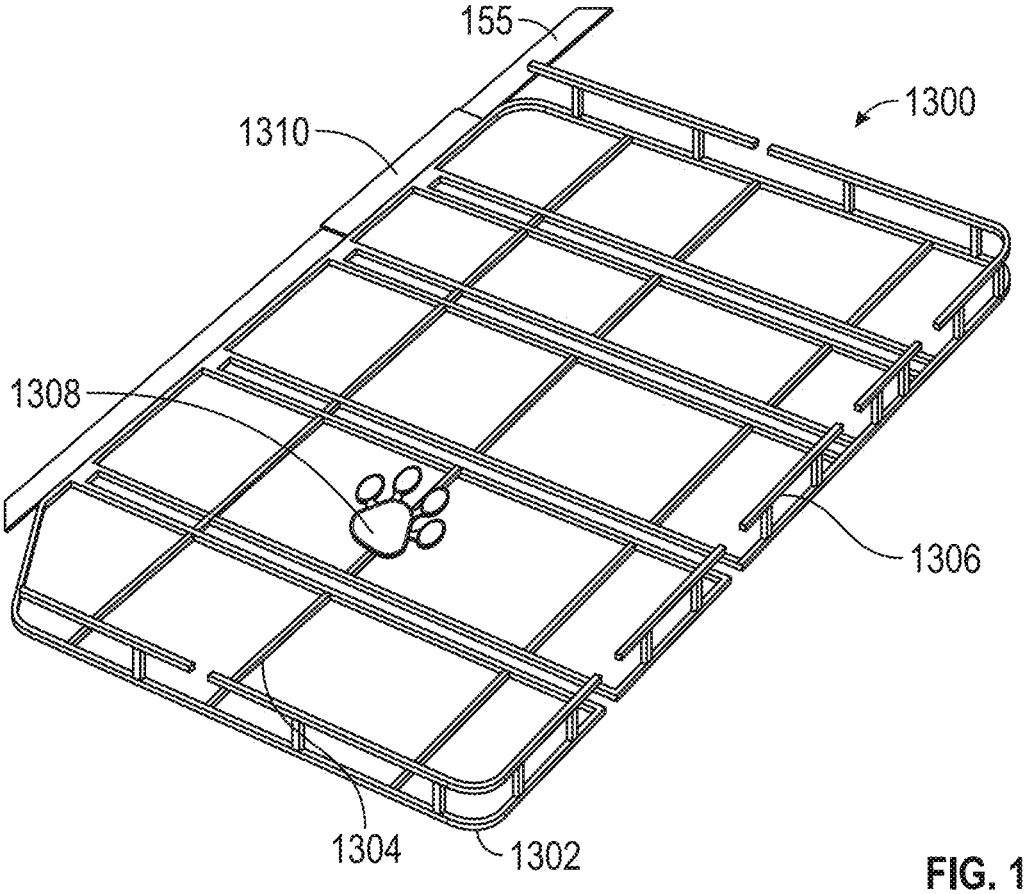
FIG. 16 illustrates a perspective view of another example of a loading zone marker for use with the dish rack assembly of FIG. 4.

FIG. 16 illustrates yet another example of a rack bottom marker 1300 for use with the dish rack assembly 120 and the dishwasher 10 described herein that is similar to the rack bottom marker 1200 of FIG. 15, and shares many of the same features and components as the rack bottom marker 1200, but differs in some aspects, such as in that the rack bottom marker 1300 includes a sidewall 1306, as in the rack bottom markers 1000, 1100. Therefore, elements of the rack bottom marker 1300 that are similar to those of the rack bottom marker 1200 are identified with numerals increased by 100, with it being understood that the description of the like parts of the rack bottom marker 1200 applies to the rack bottom marker 1300, unless otherwise noted.

The rack bottom marker 1300 is similar to the rack bottom marker 1200 in most aspects, such as in the inclusion of a body 1302 forming a tray defining an outline of a portion of the floor latticework 156 defining the loading zone, and in the inclusion of an interior grid 1304 and indicia 1308, as well as in the rotatable coupling of the rack bottom marker 1300 with the dish rack 34 by the hinge 1310, but differs from the rack bottom marker 1200 in that the rack bottom marker 1300 includes the sidewall 1306. By way of non-limiting example, the sidewall 1306 is illustrated herein as a discontinuous sidewall 1306, though it will be understood that the sidewall 1306 can instead be continuous about the entirety of the body 1302.

Figure 17:
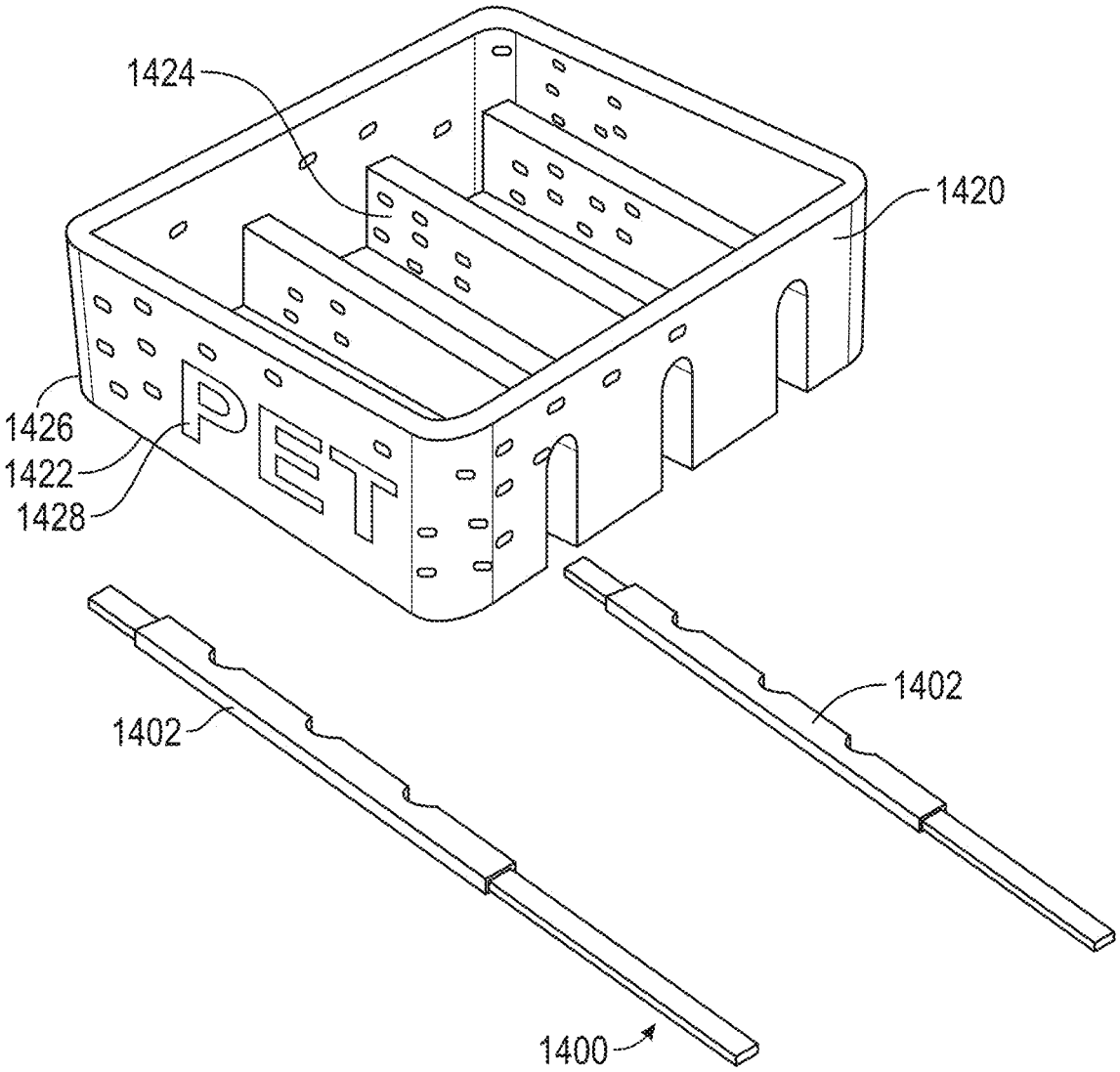
FIG. 17 illustrates a perspective view of another example of a loading zone marker for use with the dish rack assembly of FIG. 4.

FIG. 17 illustrates yet another example of a loading zone marker 1400 for use with the dish rack assembly 120 and the dishwasher 10 described herein, provided as a pair of opposing, spaced apart rack bottom markers 1402 provided with the floor latticework 156 and at least partially defining a loading zone therebetween. The rack bottom markers 1402 are coupled to the floor latticework 156 by any suitable method, non-limiting examples of which can include snap attachment, attachment by a fastener, or overmolding about the floor latticework 156. The rack bottom markers 1402 can have any suitable color for indicating a specific loading zone. Further, rather than simply delineating a portion of the floor latticework 156 that forms the loading zone, the pair of rack bottom markers 1402 can serve as a guide and attachment point for an auxiliary dish basket 1420 that can removably couple to the rack bottom markers 1402, such as by snap attachment or other frictional engagement. The dish basket 1420 comprises a base 1422 with a perimeter wall 1426 extending upwardly from the base 1422, and optionally including an internal grid or dividers 1424 for supporting dish items received within the dish basket 1420. The dish basket 1420 can also carry an indicia 1428 indicative of the type of loading zone or dish items to be loaded into the dish basket 1420.

Turning now to the operation of the dishwasher 10 with respect to the loading zone as identified by any of the loading zone markers as described herein, the loading zone can indicate the sub-section of the lower dish rack 34 within which dish items should be placed for best washing performance in a quick wash cycle of operation. For example, the loading zone can be specifically positioned to align with the areas of the dish rack 34 that receive the most spray by treating liquid, which would result in the most cleaning of dish items, even during a shortened quick wash cycle. Alternatively, or additionally, the loading zone can indicate the sub-section of the lower dish rack 34 within which certain harder-to-clean dish items, such as pet bowls, should be placed for best washing performance during a cycle of operation, whether it is a quick wash cycle of operation, or a longer, sanitizing cycle of operation. By placing the harder-to-clean dish items specifically in the loading zone that receives the best cleaning action, it can be ensured that the dish items will be sufficiently cleaned during the cycle.

The aspects of the present disclosure described herein set forth a dish rack assembly that can easily visually guide a user for where to load certain dish items, either for extra cleaning, or for use within a reduced-size load treating cycle, so that the specific dishes will still be sufficiently cleaned, even during a shortened cycle or with particularly difficult soil. This also allows for users to run a smaller load of dish items loaded into the specified loading zone and to select a cycle that will treat those dish items without operating all of the other sprayers and components for the dishwasher that are provided with the other dish racks or other portions of the dish racks. This provides cycle customization options for the user that result in improved efficiency and convenience, while still ensuring desired cleaning performance. Such a loading zone can be indicating by a variety of markers provided with the dish rack, or even with the rails of the dish rack, to indicate which portion or portions of the dish rack are suitable for loading of such dish items. In addition, such markers can include indicia to visually indicate the type of dish items to be loaded in such loading zones.

It will also be understood that various changes and/or modifications can be made without departing from the spirit of the present disclosure. By way of non-limiting example, although the present disclosure is described for use with a wire dish rack, it will be recognized that the loading zone markers can be employed with various rack constructions, including molded racks, such as racks molded of plastic.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher comprising:

a chassis having a base and forming a tub at least partially defining a treating chamber;

at least one spray nozzle configured to exhaust a flow of treating fluid into the treating chamber;

a dish rack provided within the treating chamber, the dish rack having a bottom wall, a plurality of tines extending from the bottom wall, and a front wall;

a closure moveably coupled to the base, the closure providing selective access to the tub; and at least one loading zone marker provided along one of the dish rack, the closure, or a rail coupled to the dish rack, the at least one loading zone marker providing a visual indication of a zone of the treating chamber corresponding to a location along the dish rack, the zone of the treating chamber being defined as an area within the treating chamber configured to receive the flow of treating fluid from the at least one spray nozzle during a rapid wash cycle or targeted wash cycle of the dishwasher;

wherein the at least one loading zone marker is at least one of:

located along at least one tine of the plurality of tines; moveably or removably coupled to the dish rack;

a physical indicia defined by a set of instructions provided on the closure;

a physical indicia located along the front wall;

a physical indicia corresponding to a washable item, and the zone is indicated by the at least one loading zone marker corresponds to a location within the treating chamber best suited to wash the washable item; or located along a handle of the dish rack, the handle being located along the front wall.

2. The dishwasher of claim 1, wherein the dish rack comprises the front wall, a rear wall, a side wall interconnecting the front wall and the rear wall, and the bottom wall collectively defining a dish rack interior of the dish rack, the plurality of tines being provided within the interior.

3. The dishwasher of claim 2, wherein the zone is less than an entirety of the dish rack interior.

4. The dishwasher of claim 2, wherein the at least one loading zone marker is coupled to a portion of the tines of the plurality of tines.

5. The dishwasher of claim 2, wherein the at least one loading zone marker is provided along the bottom wall.

6. The dishwasher of claim 5, wherein the at least one loading zone marker is a grid provided along the bottom wall.

7. The dishwasher of claim 2, wherein the at least one loading zone marker is provided along at least one of the side wall, the front wall, or the rear wall.

8. The dishwasher of claim 2, wherein the at least one loading zone marker comprises a rack bottom marker provided along a portion of the bottom wall.

9. The dishwasher of claim 8, wherein the rack bottom marker is at least one of moveably coupled to the dish rack or removably coupled to the dish rack.

10. The dishwasher of claim 8, wherein the rack bottom marker forms an attachment point between the dish rack and a basket couplable to the rack bottom marker.

11. The dishwasher of claim 1, wherein the at least one loading zone marker is provided along a movable tray coupled to the dish rack.

12. The dishwasher of claim 1, wherein;

the at least one loading zone marker comprises the physical indicia corresponding to the washable item, and the zone indicated by the at least one loading zone marker corresponds to the location within the treating chamber best suited to wash the washable item; and the physical indicia is a paw print and the at least one loading zone marker corresponds to a location within the treating chamber best suited to wash a food bowl or a water bowl for a pet.

13. The dishwasher of claim 1, wherein:

the at least one loading zone marker is the physical indicia defined by the set of instructions provided on the closure; and the closure comprises an interior surface confronting the treating chamber, with the at least one loading zone marker being provided along the interior surface.

14. A dishwasher comprising:

a chassis having a base and forming a tub at least partially defining a treating chamber;

at least one spray nozzle configured to exhaust a flow of treating fluid into the treating chamber;

a dish rack provided within the treating chamber, the dish rack having a set of tines and a front wall;

a closure moveably coupled to the base, the closure providing selective access to the tub;

at least one loading zone marker providing a visual indication of a zone of the treating chamber corresponding to a location along the dish rack, the zone of the treating chamber being defined as an area within the treating chamber configured to receive the flow of treating fluid from the at least one spray nozzle during a rapid wash cycle or targeted wash cycle of the dishwasher; and a rail, the dish rack being slidably receivable on the rail, and the at least one loading zone marker being an endcap defining a distal end of the rail.

15. The dishwasher of claim 14, wherein the dish rack is included in a plurality of dish racks.

16. The dishwasher of claim 15, wherein the at least one loading zone marker is included in a plurality of loading zone markers.

17. A dishwasher comprising:

a chassis having a base and forming a tub at least partially defining a treating chamber;

at least one spray nozzle configured to exhaust of flow of treating fluid into the treating chamber;

a plurality of dish racks provided within the treating chamber;

a closure moveably coupled to the base, the closure providing selective access to the tub; and a plurality of loading zone markers provided along one of the plurality dish racks, the closure, or a rail coupled to at least one dish rack of the plurality of dish racks, each loading zone marker of the plurality of loading zone markers providing a visual indication of a zone of the treating chamber corresponding to a location along the at least one dish rack, the zone of the treating chamber being defined as an area within the treating chamber configured to receive the flow of treating fluid from the at least one spray nozzle during a rapid wash cycle or targeted wash cycle of the dishwasher, the plurality of loading zone markers including at least one type of loading zone marker including a rack bottom marker, a tine marker, a rack wall marker, a rail marker, an interior grid, a movable tray, a dish basket, or a combination thereof;

wherein two or more dish racks of the plurality of dish racks include a respective portion of the plurality of loading zone markers.

18. The dishwasher of claim 17, wherein the at least one dish rack includes two or more types of loading zone markers of the plurality of loading zone markers.

19. The dishwasher of claim 17, wherein each dish rack of the plurality of dish racks includes a bottom wall, a plurality of tines extending from the bottom wall, and a front wall.

20. The dishwasher of claim 19, wherein the plurality of loading zone markers are at least one of:

located along at least one tine of the plurality of tines of the at least one dish rack of the plurality of dish racks;

moveably or removably coupled to the at least one dish rack of the plurality of dish racks;

a physical indicia defined by a set of instructions provided on the closure;

a physical indicia located along the front wall of the at least one dish rack of the plurality of dish racks;

a physical indicia corresponding to a washable item, and the zone is indicated by the at least one loading zone marker corresponds to a location within the treating chamber best suited to wash the washable item; or located along a handle of the at least one dish rack of the plurality of dish racks, the handle being located along the front wall.

* * * * *